US005339620A

United States Patent [19]

Ikeda et al.

[11] Patent Number: 5,339,620

[45] Date of Patent: Aug. 23, 1994

[54] CONTROL APPARATUS AND A CONTROL METHOD OF A GAS TURBINE COMBUSTOR

[75] Inventors: Hiraku Ikeda, Katsuta; Tetsuo Sasada, Hitachi; Isao Sato, Hitachi; Yoshikazu Moritomo, Hitachi; Koji Takahashi, Hitachi; Minoru Takaba, Hitachi, all of Japan

[73] Assignee: Hitachi, Ltd., Tokyo, Japan

[21] Appl. No.: 872,139

[22] Filed: Apr. 22, 1992

[51] Int. Cl.[5] ..... F02C 9/50

[52] U.S. Cl. ..... 60/39.03; 60/39.27

[58] Field of Search ..... 60/39.03, 39.06, 39.27, 60/39.281, 39.29, 240, 243

[56] References Cited

U.S. PATENT DOCUMENTS

| | | | |
|---|---|---|---|
| 3,797,233 | 3/1974 | Webb et al. | 60/240 |
| 3,854,287 | 12/1974 | Rembold | 60/243 |
| 4,566,266 | 1/1986 | Kidd et al. | 60/39.06 |
| 5,121,597 | 6/1992 | Urushidani et al. | 60/39.06 |

OTHER PUBLICATIONS

Patent Abstracts of Japan vol. 9, No. 235 (M-962) Apr. 16, 1990 & JP-A-2 033 419 (Hitachi) Feb. 2, 1990.

Patent Abstracts of Japan vol. 9, No. 235 (M-415) Sep. 1985 & JP-A-60091 141 (Hitachi) May 22, 1985.

*Primary Examiner*—Louis J. Casaregola

*Attorney, Agent, or Firm*—Antonelli, Terry, Stout & Kraus

[57] ABSTRACT

A control apparatus of a gas turbine combustor obtains a stable combustion with limited NOx emission through a control of a fuel flow rate according to a turbine output and a control of a flow rate of intake air mixed with the fuel. The control apparatus includes an apparatus for detecting at least one of the temperature and the humidity of intake air taken into the combustor, an apparatus for determining and storing, in advance, a stable combustion limit line between a stable combustion region and an unstable combustion region, on a plane of coordinates of a ratio of fuel flow rate to an intake air flow rate or an intake air flow rate and the temperature or the humidity of the intake air, on each turbine load, an apparatus for detecting an instant operational point of the combustor on the plane of coordinates, and an apparatus for correcting the intake air flow rate or the ratio of fuel flow rate to the intake air flow rate according to an increase in the detected temperature or humidity so that the instant operational point does not cross the stable combustion limit line.

15 Claims, 4 Drawing Sheets

CONTROL APPARATUS AND A CONTROL METHOD OF A GAS TURBINE COMBUSTOR

BACKGROUND OF THE INVENTION

The present invention relates to a control apparatus of a gas turbine combustor and, more particularly, to a control apparatus of a gas turbine combustor for effecting a stable combustion with limited NOx emission through a control of a fuel flow rate and a control of an air flow rate of an intake air to be mixed with the fuel.

A two-stage type low NOx gas turbine combustor which effects combustion with low NOx emission and suppressed uncombustion products such as CO, HC is disclosed in JP A 60-91141. The gas turbine combustor comprises a head combustion chamber for effecting a first stage combustion with first stage fuel and a first stage combustion air introduced therein and a main combustion chamber at a downstream side of the head combustion chamber for effecting combustion with a mixture of second stage fuel and a second stage combustion air. The combustor is characterized by the provision of means for changing a flow rate of the second stage combustion air. The combustor controls a flow rate of the second stage combustion air according to a gas turbine output to be surplus air. Therefore, if the gas turbine output is constant, a flow rate of the second stage combustion air becomes constant and a fuel/air ratio also is constant. In this conventional combustor, the flow rate of the second stage combustion air is set, in advance, as a function of a gas turbine output, and the flow rate is increased according to the function as an increase of the gas turbine output.

In this conventional combustor, a change in intake air conditions is not taken into consideration, and there is a problem that since the same air flow rate is taken at the same gas turbine output, the combustion temperature lowers when the absolute humidity of the intake air increases, and the combustion condition shifts into an unstable combustion region. Further, it has a problem that when the absolute humidity of the intake air decreases, a generation amount of NOx increases beyond a limit value.

Further, JP A 2-33419 discloses a gas turbine combustor which is provided with a detector for detecting the humidity of combustion air and controlled to shift a control setting according to the detected humidity, in order to effect a stable combustion with a low NOx emission over the year without being influenced by atmosphere humidity conditions. The prior art JP A 2-33419 does not clearly disclose a concrete method of control on the basis of detection of the intake air humidity, but discloses, in the embodiment, that a humidity sensor 18 for detecting the humidity of air introduced into the combustor is provided on the upstream side of a compressor, and the signal is inputted into a valve controller 17, whereby a control of valve opening is shifted according to the humidity as shown in FIG. 4 (FIG. 4 is a prior art, therefore it may be FIG. 2).

SUMMARY OF THE INVENTION

An object of the invention is to provide a control apparatus and a control method of a gas turbine combustor which can prevent a combustion state from shifting into an unstable combustion region when the absolute humidity of intake air of the gas turbine combustor increases.

Another object of the invention is to provide a control apparatus and a control method of a gas turbine combustor which can prevent a combustion state from shifting into an unstable combustion region when the absolute humidity of intake air of the gas turbine combustor increases, and NOx emission from increasing beyond a limit value when the above mentioned absolute humidity decreases.

An aspect of the invention is characterized by a control apparatus of a gas turbine combustor for effecting a stable combustion with limited NOx emission through a control of a fuel flow rate according to a turbine output and a control of a flow rate of intake air mixed with the fuel, which control apparatus comprises:

means for detecting at least one of the temperature and the humidity of an intake air to be taken into the combustor;

means for determining and storing, in advance, a stable combustion limit line between a stable combustion region and an unstable combustion region, on a plane of coordinates of a ratio of fuel flow rate/intake air flow rate or an intake air flow rate and the temperature or the humidity of the intake air, on each turbine load;

means for detecting an instant operational point of the combustor on the plane of coordinates; and means for correcting an intake air flow rate or a ratio of fuel flow rate to the intake air flow rate according to an increase in the detected temperature or humidity so that the operational point does not cross the stable combustion limit line.

According to this aspect of the invention, for example, when the operational point on each coordinates concerning each turbine load moves from the stable combustion region into the unstable combustion region beyond the stable combustion limit line because of change in the absolute humidity of intake air to be taken into the gas turbine combustor, the control apparatus corrects the air flow rate to keep the operational point within the stable combustion region.

Another aspect of the invention is characterized in that a gas turbine combustor control apparatus comprises:

means for detecting at least one of temperature and the humidity of an intake air to be taken into the combustor;

means for determining and storing, in advance, an allowable operational region, defined by an allowable NOx emission limit line and a stable combustion limit line, on a plane of coordinates of a ratio of fuel flow rate/intake flow rate or intake air flow rate and the temperature or the humidity of the intake air, on each range of turbine load;

means for detecting an instant operational point; and means for correcting the intake air flow rate or the ratio of fuel flow rate to the intake air flow rate according to change in the detected temperature or humidity so that the operational point is kept within the allowable operational region.

According to this control apparatus, in addition to the above mentioned correction control, if the operation point on each coordinates moves out of an unallowable operation region beyond the NOx emission limit line, the control apparatus controls to correct an air flow rate so as to keep the operational point within the allowable operation region defined by the NOx emission limit line and the stable combustion limit line.

DESCRIPTION OF EMBODIMENTS OF THE INVENTION

Figure 1:
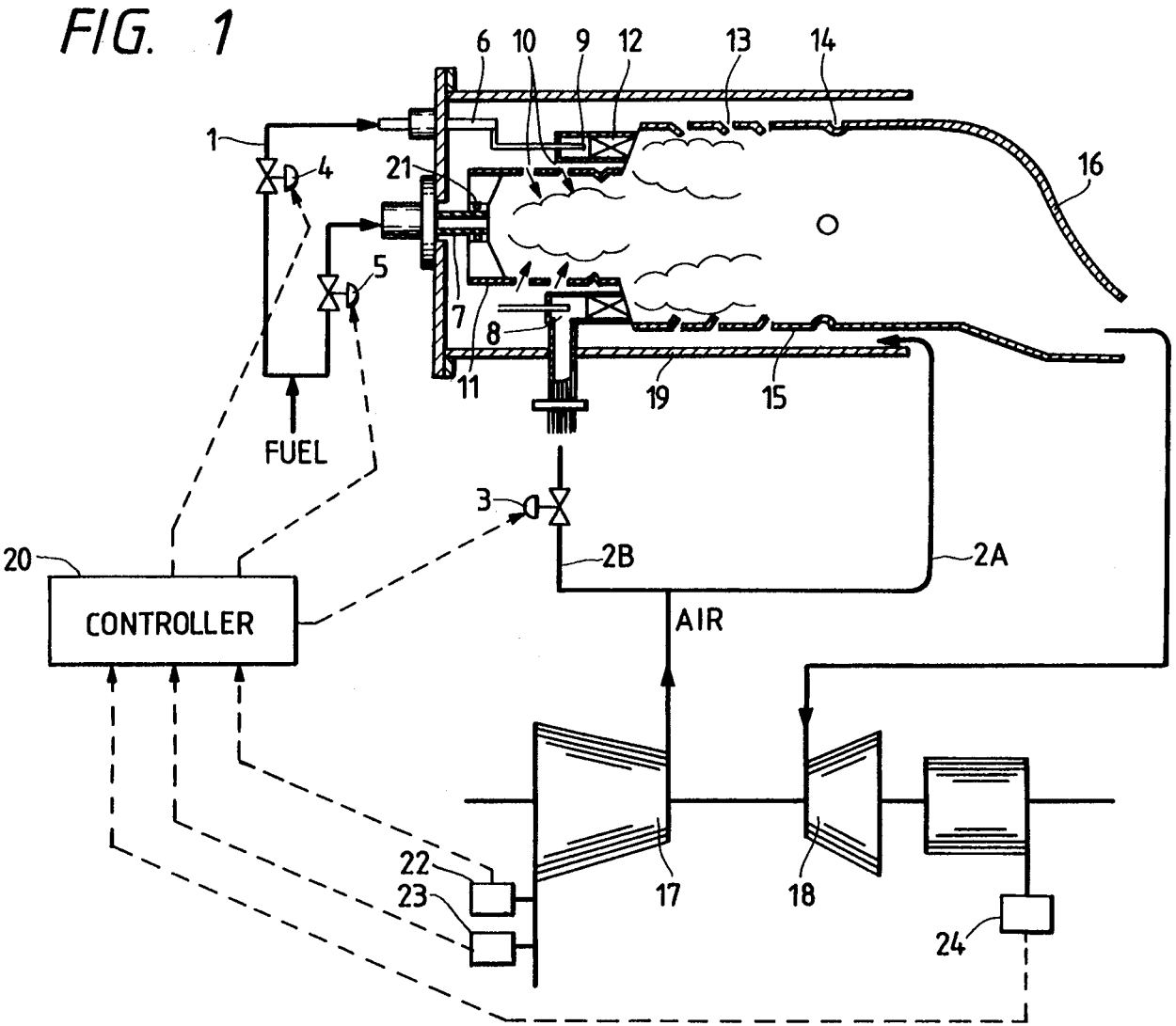
FIG. 1 is a vertical sectional view showing a two stage gas turbine combustor employing the invention.

Embodiments of the invention are described hereunder referring to the drawings.

In FIG. 1 showing a two stage gas turbine combustor, the combustor comprises a cylindrical casing formed of a sub-chamber 11 and a main chamber 15 disposed at a downstream side of the sub-chamber 11, and an outer cylinder 19 surrounding the cylindrical casing. At the end of the sub-chamber 11, a first stage burner part having a first stage fuel nozzle 7 and a swiller 21 around the nozzle 7 is provided. At the end of the main chamber 15 at close to the sub-chamber 11, a second burner part 8 having an annular second stage fuel nozzle 9 and a swiller 12 is provided. First stage fuel is supplied to the first stage fuel nozzle 7 through a first stage fuel regulation valve 5. Second stage fuel is supplied to the second stage fuel nozzle 9 through a second stage fuel regulation valve 4 and pipes 6, 1.

Air discharged from a compressor 17 driven by the gas turbine 18 is divided into two portions 2A, 2B, one portion 2A of the air passes between the outer cylinder 19 and the main chamber 15 and enters the sub-chamber 11 at the swiller 21 and holes 10 of the sub-chamber 11, and then the air is mixed with first stage fuel injected from the nozzle 7 and burns the first stage fuel. Further, a portion of the air 2A enters the main chamber at main chamber cooling holes 13 and used as cooling air when the portion of the air 2A passes between the outer cylinder 19 and the main chamber 15. Another portion enters the main chamber 15 at dilution holes 14 and cools a rear part of the main chamber 15 and a transition piece 16. Another air portion 2B which is divided from the portion mentioned above passes through the air flow rate regulation valve 3. The air portion is mixed, as second stage air, with second stage fuel from the nozzle 9 of the second stage burner part 8, and enters the main chamber 15 through the swiller 12 and burns the second stage fuel. All of the combustion gas are introduced into the gas turbine 18 through the transition piece 16 and drives the gas turbine.

A fuel air ratio control apparatus 20 regulates the first and second stage fuel regulation valves 5 and 4 to control the first fuel and second stage fuel according to a gas turbine output detected by an output detector 24. The above mentioned control apparatus 20, further, controls a second stage air flow rate according to the gas turbine output by regulating the second stage air flow rate regulation valve 3 in the same manner as the prior art to be at a prescribed fuel/air ratio. In the present invention, as will be described later in detail, for example a second stage air flow rate is corrected so as to prevent the gas turbine combustor from running outside of a stable combustion limit line and/or NOx emission limit line depending on the change of the absolute humidity of gas turbine combustor intake air (further, when the second stage air flow rate is changed, as a natural result, the first stage air flow rate also changes).

The humidity of intake air is detected by a humidity sensor 22 provided in the pipe leading to the compressor 17. If necessary, a temperature sensor 23 is provided to detect the temperature of the intake air. Further, a flow rate of second stage air can be detected by an air flow sensor (not shown) provided downstream of the air flow rate regulation valve 3, or obtained by detection of a flow rate of the intake air into the compressor 17 and calculation of a second stage air flow rate on the basis of the detected intake air flow rate and the structure of the combustor, or by the calculation of a second stage air flow rate on the basis of the r.p.m. of the gas turbine 18 and the temperature of the intake air by a conventional method.

Hereunder, several embodiments concerning a control of the second stage air flow rate or a ratio of second stage fuel flow rate to the second stage air flow rate will be described referring to FIGS. 1 to 6.

Figure 2:
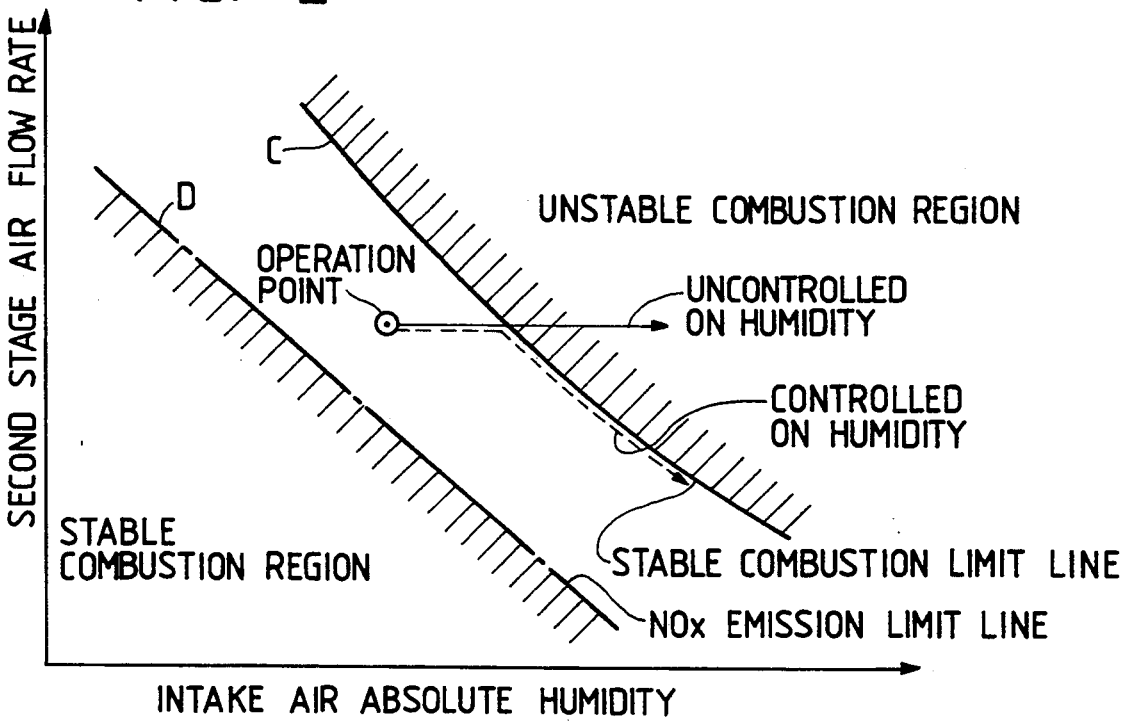
FIG. 2 is a diagram showing a relationship between the absolute humidity of intake air and second stage air flow rate for explanation an embodiment of the invention.

FIG. 2 is a diagram for explanation of an embodiment. In FIG. 2, an abscissa is the absolute humidity of the intake air of the gas turbine combustor and an ordinate is a second stage air flow rate. A region on the right of a stable combustion limit line C is an unstable combustion region, and a region on the left of the line C is a stable combustion region. On the other hand, a region on the right of a NOx emission limit line D is a region in which a generation or emission amount of NOx (nitrogen oxides) is less than a limit value, and a region on the left of the line D is a region in which a generation amount of NOx is more than the limit value. Accordingly, it is necessary to operate the gas turbine combustor so that an operational point thereof is positioned in a region on the left of the stable combustion limit line C and on the right of the NOx limit line. These stable combustion limit line C and NOx emission limit line D are changeable depending on a gas turbine output, so that the stable combustion limit line and the NOx limit line are determined on each of various turbine outputs by advance experiment.

The coordinates are determined and stored in the control apparatus 20 on each turbine output in advance.

Now, in the gas turbine combustor running at a certain output, with an operational point being positioned as illustrated in FIG. 2, when the absolute humidity of intake air of the gas turbine combustor becomes high, the operational point comes close to the unstable combustion region. Here, the operational point is corrected as shown by a broken line in FIG. 2 to secure stable combustion by reducing the second stage air flow rate by an operation of the second stage air flow rate regulation valve 3 according to the intake air absolute humidity so that the operational point does not into the unstable combustion region beyond the stable combustion limit line C. In the same manner, when the absolute humidity of the intake air lowers and the operational point comes close to the NOx emission limit line D, the second stage air flow rate is increased so that the operational point does not enter the region on the left of the NOx emission limit line D. When the gas turbine output changes, it is sufficient to effect a control similar to the above on the stable combustion limit line C and the NOx emission limit line D at the output.

The operational point is determined by the detected absolute humidity and the detected second stage air flow rate.

The stable combustion line C and the NOx emission limit line D define an allowable operation region therebetween. Therefore, the control apparatus 20 controls the second stage air flow rate so that the operational point is kept within the allowable operation region, whereby the gas turbine combustor can effect a stable combustion with a minimized NOx emission.

Figure 3:
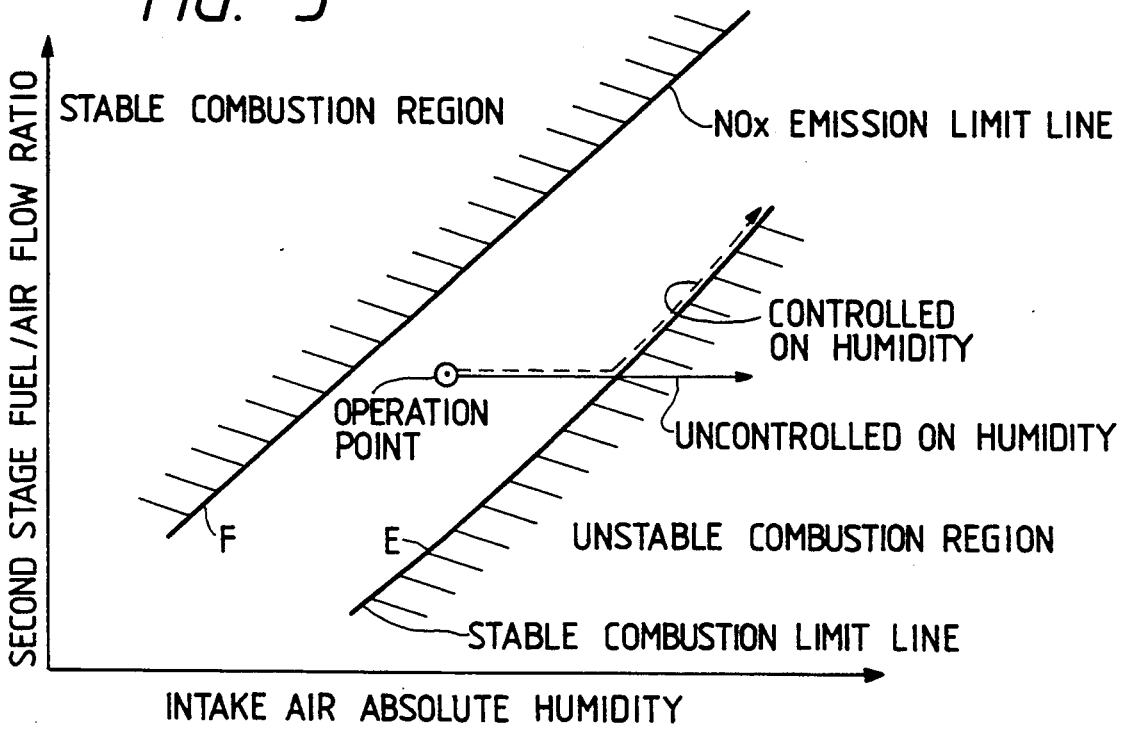
FIG. 3 is a diagram showing a relationship between the absolute humidity of intake air and a ratio of second stage fuel/air flow rate for explanation another embodiment of the invention.

FIG. 3 is a diagram for the explanation of another embodiment, and it has the absolute humidity of intake air of the gas turbine combustor on the abscissa and a fuel/air flow rate ratio of a second stage on the ordinate. Regions on the left and the right of an unstable combustion limit line E are a stable combustion region and an unstable combustion region, respectively. On the other hand, regions on the left and on the right of NOx emission limit line F are a region in which a generation amount of NOx is more than a NOx emission limit value and a region in which the NOx generation amount is less than the limit value, respectively. Therefore, it is necessary to operate the gas turbine combustor so that an operation point will be in a region on the left of the stable combustion limit line E and on the right of the NOx emission limit line F. In this FIG. 3, the stable combustion limit line E is substantially constant irrespective of change in turbine output, however, it is necessary to obtain the NOx limit line F on each turbine output. In this embodiment, it is the same as in the previous embodiment that even if the intake air absolute humidity changes, a second stage air flow rate is adjusted according to a detected value of the intake air absolute humidity so that the operational point is kept in the region between the stable combustion limit line E and the NOx limit line F, that is, an allowable operation region.

Further, although there are various NOx emission limit lines corresponding to various turbine outputs, by employing, as a common NOx limit line, a NOx emission limit line on the most right of the NOx emission limit lines, that is, a most severe NOx emission limit line, a second stage air flow rate can be adjusted so that the operational point will not deviate from the above mentioned common NOx limit line irrespective of change in the turbine output.

Figure 4:
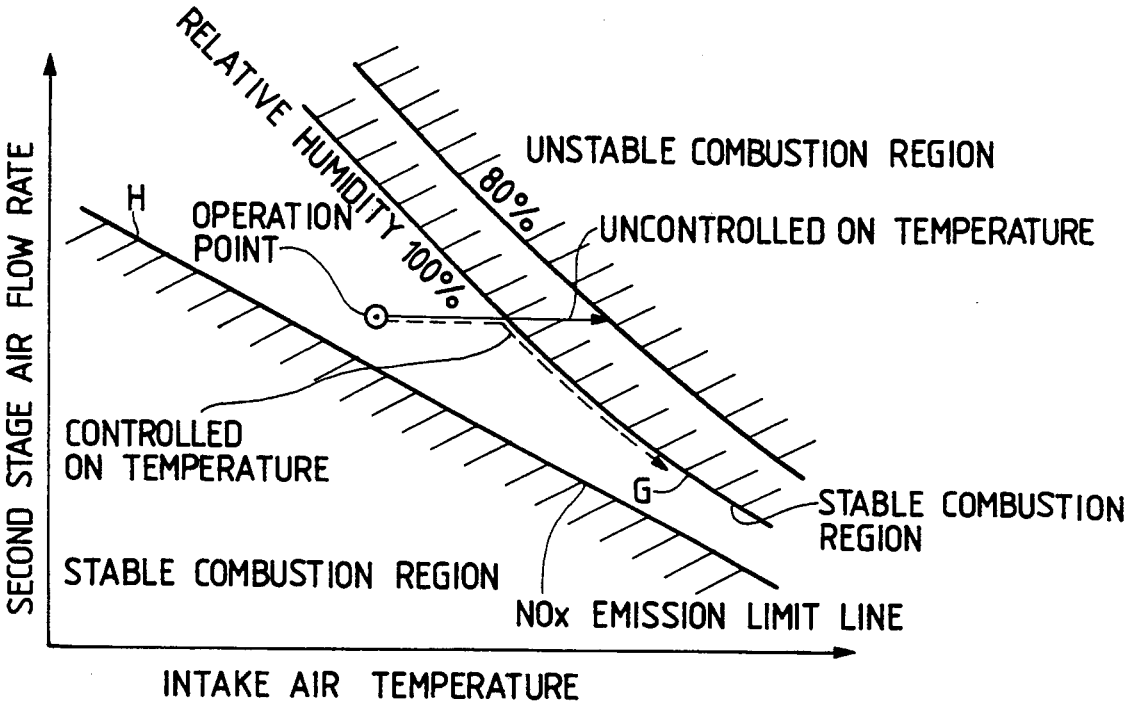
FIG. 4 is a diagram showing a relationship between the temperature of intake air and second stage air flow rate for explanation of another embodiment of the invention.

FIG. 4 is an explanation diagram of further another embodiment. The diagram shows a coordinates which has the intake air temperature of a gas turbine combustor on the abscissa and a second stage air flow rate on the ordinate. In FIG. 4, a stable combustion limit line G and a NOx emission limit line H are expressed by a plurality of lines with the relative humidity of intake air as a parameter. Regions on the left and on the right of the stable combustion limit line G are a stable combustion region and an unstable combustion region, respectively. Regions on the left and on the right of the NOx emission limit line H are a region in which a NOx generation amount is more than a limit value and a region in which the NOx generation amount is less than the NOx limit value, respectively. These stable combustion limit line G and the NOx emission limit line H are determined by advance experiments for each of various gas turbine outputs. Now, in case of a certain constant turbine output, when the operation point moves away from the region between the stable combustion limit line G and the NOx emission limit line H at the relative humidity of the intake gas, the second stage air flow rate is adjusted according to the intake air temperature so that the operational point will be kept in a region between the above mentioned lines G and H. When the gas turbine output changes, the similar control can be effected according to the stable combustion limit line G and the NOx emission limit line H at the its gas turbine output.

In this embodiment, when the fuel/air flow rate control apparatus 20 effects the above mentioned control, the temperature of the intake gas of the gas turbine combustor and the relative humidity thereof are detected. However, in view of the fact that the stable combustion limit line G moves rightward as the relative humidity of the gas turbine combustor intake air lowers from 100% as shown in FIG. 4 the apparatus can be constructed so as to effect a control similar to the above control by using only a stable combustion limit line corresponding to a relative humidity 100% or really prospective maximum relative humidity, irrespective of how the intake air takes a real relative humidity. Further, as for the NOx emission limit line H, also, when it changes depending on the relative humidity of the intake air, the apparatus can be constructed so as to control in the similar manner to the above by employing only the most right NOx emission limit line irrespective of real relative humidity of the intake air. By such a construction of control apparatus, the object of stabilization of combustion and prevention of occurrence of NOx more than a limit value can be achieved, and as for measurement of intake air, only measurement of temperature is sufficient to effect the above-mentioned control so that it is not necessary to measure absolute humidity or relative humidity.

Figure 5:
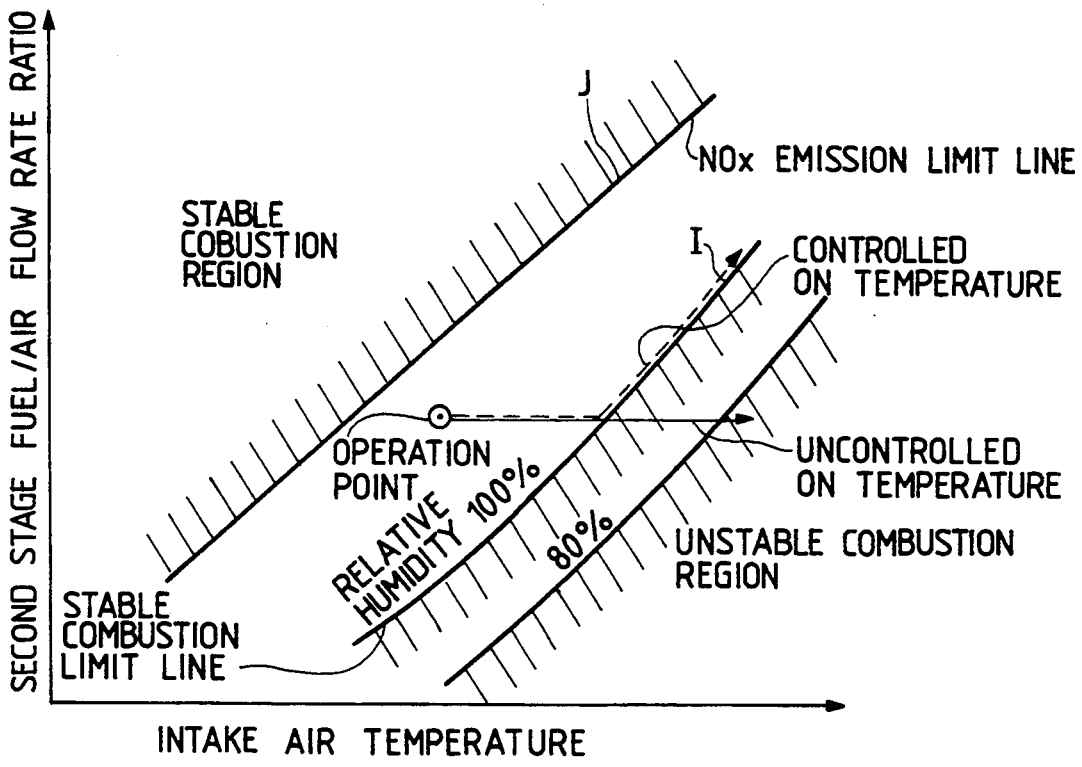
FIG. 5 is a diagram showing a relationship between the temperature of intake air and a ratio of second stage fuel/air flow rate for explanation of another embodiment of the invention.

FIG. 5 is an explanation diagram of further another embodiment expressing coordinates different from FIG. 4 in that a fuel/air flow rate ratio of second stage is taken on the ordinate. The control is the same as the above mentioned embodiment in FIG. 4, in principle. In the present embodiment, also, irrespective of a value of real relative humidity of the intake air, a stable combustion limit line at the relative humidity of 100% or a really prospective maximum relative humidity is always used as a stable combustion limit line I, and as for a NOx emission limit line, one on the most right thereof is employed, whereby as for the measurement of the intake air it is sufficient to measure temperature only.

Further, in each embodiment as mentioned above, in case the NOx emission limit line is in the unstable combustion region, that is, in case both conditions that a NOx occurrence amount is kept less than a limit value and that combustion is kept in the stable combustion region are not satisfied, a priority is given to adjustment of a second stage air flow rate so as to keep the operation point in the stable combustion region. In this case, an amount of NOx emission can be decreased less than a limit value by employing an exhaust gas denitration apparatus at the downstream side of the gas turbine.

Figure 6:
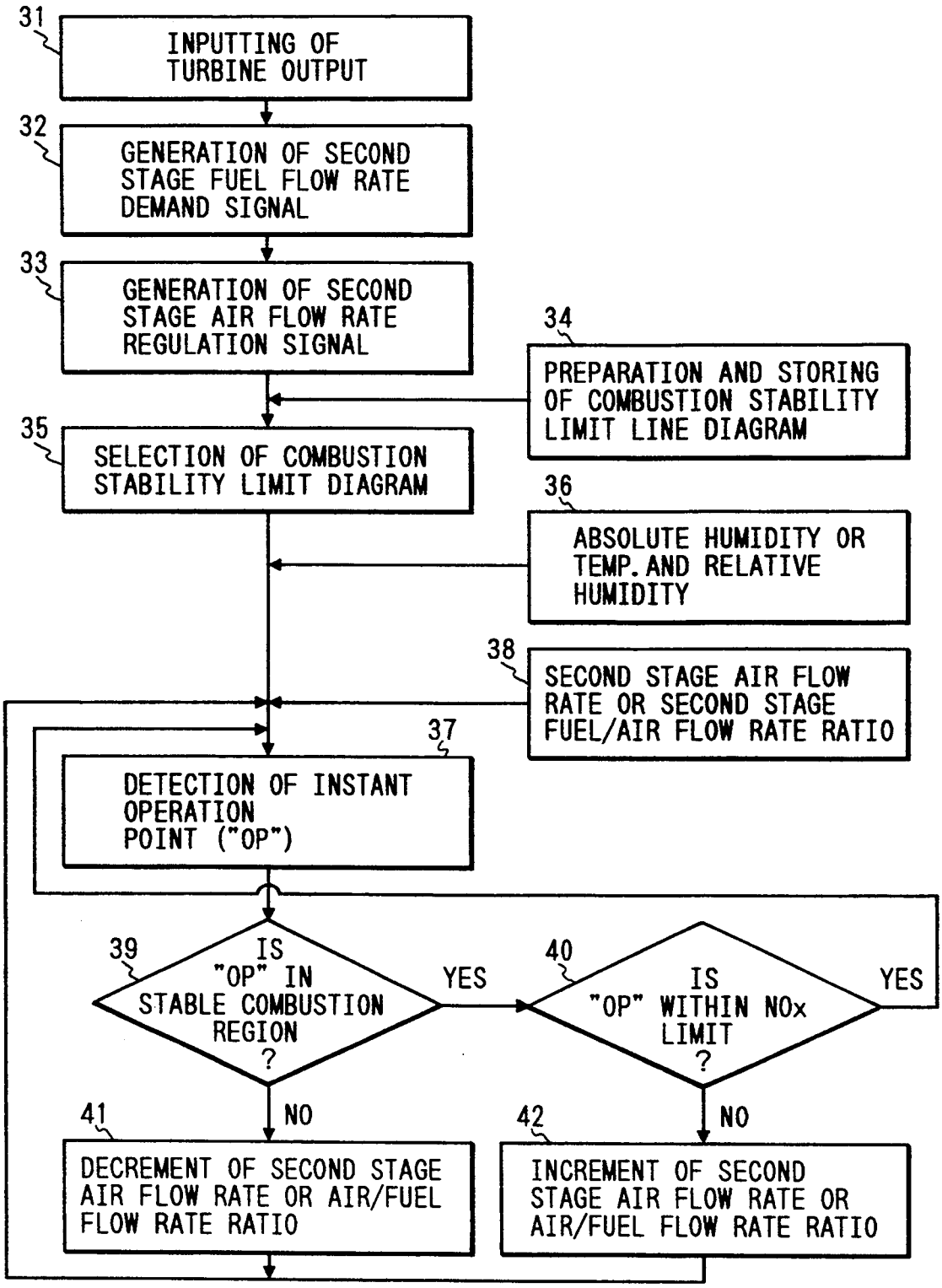
FIG. 6 is a flow chart of the control of gas turbine combustor.

In FIG. 6, a flow chart of the gas turbine combustor control on second stage combustion is shown. In FIG. 6, the control apparatus 20 is inputted of turbine output planned or detected by the detector 24 in step 31. The control apparatus 20 generates second stage fuel flow rate demand signals to regulate the second stage fuel regulation valve 4 according to the turbine output in step 32. The control apparatus 20 further regulates the second stage intake air regulation valve 3 according to the fuel flow rate to be supplied to the second stage burner part 8 so that a second stage fuel/air flow rate ratio will be a predetermined value in step 33. The coordinates as shown in FIGS. 2 to 5, that is, combustion stability limit line diagrams or tables are prepared and stored in the control apparatus 20, in advance, in step 34. The control apparatus 20 selects a combustion stability limit line diagram from the prepared and stored combustion stability limit line diagrams according to the turbine output in step 35. An instant operational point on the selected diagram is confirmed or detected in step 37, based on the absolute humidity or the temperature and the relative humidity of intake air to be taken into the combustor (step 36) and second stage air flow rate or second stage fuel/air flow rate ratio (step 38). The operational point is examined on whether it is in the stable combustion region in step 39. If the result is no, the control apparatus 20 instructs the second stage air flow rate regulation valve 3 to decrement the flow rate of the air to be taken into the combustor, or air/fuel flow rate ratio in step 41. If the result is yes, the operational point is further examined on whether it crosses the NOx emission limit line in step 40, and the result is no, the second stage air flow rate or air/fuel flow rate ratio is decrement by the control apparatus 20 in step 42. If the result is yes in step 40, the control apparatus does not instruct the second stage air flow rate regulation valve 3, but continues to monitor the operational point.

The above mentioned explanation is concerned with two-stage type gas turbine combustors, however, gas turbine combustors of only one stage also have the same effect by applying the present invention to adjustment of an amount of air to be supplied to a combustion part.

In order to apply the control set forth in each of the above embodiments, the stable combustion limit line and the NOx emission limit line is attained in advance by experiment and stored in the fuel/air flow rate control apparatus 20 in form of a table (when these lines differ depending on the above mentioned relative humidity and the gas turbine output as parameters, it is stored in tables corresponding to each of them), and it is used for the control.

According to the invention, even if absolute humidity of the intake air of the gas turbine combustor changes, it can be avoided that the combustion state comes into the unstable combustion region or that a NOx occurrence amount increases beyond a limit value.

What is claimed is:

1. A control apparatus of a gas turbine combustor for effecting a stable combustion with limited NOx emission through control of a fuel flow rate in accordance with a turbine output and control of a flow rate of intake air mixed with fuel of the gas turbine combustor, said control apparatus comprising:

means for detecting at least one condition of said intake air to be taken into said gas turbine combustor, combustion stability in and NOx emission from the combustor being a function of said condition of the intake air;

means for determining and storing, in advance of an operation of said gas turbine combustor, a stable combustion limit line of the gas turbine combustor between a stable combustion region of the gas turbine combustor and an unstable combustion region of the gas turbine combustor and a NOx emission limit line, on a plane of coordinates of a parameter which is a function of at least an intake air flow rate of the intake air and said condition of the intake air, on each turbine output;

means for detecting an instant operational point of said gas turbine combustor on said plane of coordinates; and means for correcting a ratio of fuel flow rate to the intake air flow rate in accordance with a change in said detected condition of the intake air so that said instant operational point is kept between said stable combustion limit line and said NOx emission limit line.

2. A control apparatus according to claim 1, wherein said detecting means detects as said condition the temperature of the intake air taken in said gas turbine combustor, and wherein said determining and storing means determines and stores said stable combustion limit line with a parameter of relative humidity, on the plane of the coordinates of the ratio of the fuel flow rate to the intake air flow rate and the temperature of the intake air, on each turbine output, and wherein said correcting means corrects the ratio of the fuel flow rate to the intake air flow rate in accordance with an increase in the detected temperature so that said instant operational point does not cross said stable combustion limit line and said NOx emission line.

3. A control apparatus of a gas turbine combustor for effecting a stable combustion with limited NOx emission through a control of a fuel flow rate in accordance with a turbine output and a control of a flow rate of intake air mixed with fuel, said control apparatus comprises:

means for detecting at least one condition of intake air taken into said gas turbine combustor, combustion stability in and NOx emission from the combustor being a function of said condition of the intake air;

means for determining and storing, in advance of an operation of said gas turbine combustor, an allowable operational region, defined by an allowable NOx emission limit line and a stable combustion limit line, on a plane of coordinates of a parameter which is a function of at least the intake air flow rate and said condition of the intake air on each turbine output;

means for detection of an instant operational point; and means for correcting the ratio of fuel flow rate to the intake air flow rate in accordance with a change in said detected condition of the intake air so that said instant operational point is kept within said allowable operational region.

4. A control apparatus according to claim 8, wherein said detecting means detects as said condition the temperature of the intake air taken in said gas turbine combustor and wherein said determining and storing means determines and stores the allowable operational region defined by the allowable NOx emission limit line and the stable combustion limit line with a parameter of relative humidity, on the plane of the coordinates of the ratio of fuel flow rate to the intake air flow rate and the temperature of the intake air, on each turbine output, and wherein said correcting means corrects the ratio of fuel flow rate to the intake air flow rate in accordance with a change in the detected temperature so that said instant operational point is kept within said allowable operational region.

5. A control apparatus according to claim 1, wherein said gas turbine combustor is a two-stage type and is provided with a first stage burner and a second stage burner, and wherein said parameter in said coordinates is a function of at least the second stage intake air flow rate for said second stage burner, and wherein said correcting means corrects a ratio of the second stage fuel flow rate to the second stage intake air flow rate.

6. A control apparatus according to claim 3, wherein said gas turbine combustor is a two-stage type and is provided with a first stage burner and a second stage burner, wherein said parameter in said coordinates is a function of at least the second stage intake air flow rate for said second stage burner, and wherein said correcting means corrects a ratio of the second stage fuel flow rate to the second stage intake air flow rate.

7. A control method of a gas turbine combustor for obtaining ga stable combustion with limited NOx emission through a control of a fuel flow rate in accordance with a turbine output and a control of a flow rate of intake air mixed with fuel, said control method comprising the steps of:

detecting a temperature of intake air taken into said gas turbine combustor;

determining and storing, in advance of an operation of the gas turbine combustor, a stable combustion limit line between a stable combustion region and an unstable combustion region and a NOx emission limit line, on a plane of coordinates of a ratio of the fuel flow rate to an intake air flow rate and the temperature, on each turbine output;

detecting an instant operational point of said gas turbine combustor on said coordinates; and correcting the ratio of fuel flow rate to the intake air flow rate in accordance with a change in the detected temperature so that said instant operational point is kept between said stable combustion limit lime and said NOx emission limit line.

8. A control method of a gas turbine combustor for obtaining a stable combustion with limited NOx emission through a control of a fuel flow rate in accordance with a turbine output and a control of a flow rate of intake air mixed with fuel, said control method comprising the steps of:

detecting a temperature of intake air taken into said gas turbine combustor;

determining and storing, in advance of an operation of the gas turbine combustor, an allowable operational region, said allowable operational region being defined by an allowable NOx emission limit line and a stable combustion limit line, on a plane of coordinates of a ratio of fuel flow rate to an intake air flow rate and the temperature on each turbine output;

detecting an instant operational point; and correcting the ratio of fuel flow rate to the intake air flow rate in accordance with a change in the detected temperature and so that said instant operational point is kept within said allowable operational region.

9. A control apparatus according to claim 1, wherein said detecting means detects as said condition the temperature of the intake air taken into said combustor.

10. A control apparatus according to claim 1, wherein said parameter is a ratio of the fuel flow rate to an intake air flow rate of the intake air taken into said combustor.

11. A control apparatus according to claim 3, wherein said detecting means detects as said condition the temperature of the intake air taken into said combustor.

12. A control apparatus according to claim 3, wherein said parameter is a ratio of the fuel flow rate to an intake air flow rate of the intake air taken into said combustor.

13. A control apparatus of a gas turbine combustor for effecting a stable combustion with limited NOx emission through a control of a fuel flow rate in accordance with a turbine output and a control of a flow rate of intake air mixed with fuel, said control apparatus comprises:

means for detecting at least one condition of intake air taken into said gas turbine combustor, combustion stability in and NOx emission from the combustor being a function of said condition of the intake air;

means for determining and storing, in advance of an operation of said gas turbine combustor, an allowable operational region, defined by an allowable NOx emission limit line and a stable combustion limit line, on a plane of coordinates of a parameter which is a function of at least the intake air flow rate and said condition of the intake air on each turbine output;

means for detection of an instant operational point of said gas turbine combustor on said plane of coordinates;

means for correcting said parameter in accordance with a change in said detected condition of the intake air so that said instant operational point is kept within said allowable operational region.

14. A control apparatus according to claim 13, wherein said parameter is a ratio of a fuel flow rate and an intake air flow rate, and said condition of the intake air is a temperature of the intake air.

15. A control apparatus according to claim 13, wherein said stable combustion limit line in said coordinates has as a parameter relative humidity in the intake air.

* * * * *